US007380635B2

(12) United States Patent
Harris

(10) Patent No.: US 7,380,635 B2
(45) Date of Patent: Jun. 3, 2008

(54) INTERFERENCE-BASED EXHAUST NOISE ATTENUATION

(76) Inventor: Gregory Leigh Harris, 1114 Arundel Ave., Westerville, OH (US) 43081

( * ) Notice: Subject to any disclaimer, the term of this patent is extended or adjusted under 35 U.S.C. 154(b) by 187 days.

(21) Appl. No.: 10/873,946

(22) Filed: Jun. 22, 2004

(65) Prior Publication Data

US 2005/0279569 A1 Dec. 22, 2005

(51) Int. Cl.
*F01N 1/06* (2006.01)

(52) U.S. Cl. ..... 181/206; 181/250; 181/251; 181/257; 181/268; 181/273; 181/275; 181/276; 181/279; 181/280

(58) Field of Classification Search ..... 181/250, 181/251, 257, 268, 273, 275, 276, 279, 280
See application file for complete search history.

(56) References Cited

U.S. PATENT DOCUMENTS 1,772,589 A * 8/1930 Beamer ..... 181/265
2,073,218 A * 3/1937 Mordt ..... 181/268
2,139,736 A * 12/1938 Durham ..... 181/274
3,704,763 A * 12/1972 Becker et al. ..... 181/268
3,948,348 A 4/1976 Bychinsky
3,948,349 A 4/1976 Bychinsky
4,165,798 A * 8/1979 Martinez ..... 181/268
4,317,502 A 3/1982 Harris et al.
4,331,213 A * 5/1982 Taniguchi ..... 181/263
4,485,890 A 12/1984 Harris et al.
4,809,812 A * 3/1989 Flugger ..... 181/268
4,831,885 A * 5/1989 Dahlin ..... 73/861.355
5,033,581 A * 7/1991 Feuling ..... 181/257
5,519,994 A * 5/1996 Hill ..... 60/313
5,824,927 A * 10/1998 Tonon ..... 84/375
D414,452 S * 9/1999 Verlengiere ..... D12/194
6,595,320 B2 * 7/2003 Hwang et al. ..... 181/253
6,633,646 B1 * 10/2003 Hwang ..... 381/71.5
6,959,782 B2 * 11/2005 Brower et al. ..... 181/272
7,117,973 B2 * 10/2006 Graefenstein ..... 181/253
2002/0153198 A1 * 10/2002 Hwang et al. ..... 181/253
2005/0164628 A1 * 7/2005 Lee et al. ..... 454/341

* cited by examiner

*Primary Examiner*—Lincoln Donovan
*Assistant Examiner*—Jeremy Luks
(74) *Attorney, Agent, or Firm*—Dane C. Butzer

(57) ABSTRACT

An interference-based exhaust noise attenuation device and method for exhaust flow from an internal combustion engine that generates compressive waves in the exhaust flow. The device includes at least a direct path for the exhaust flow; a looped path for the exhaust flow, with volumes of the direct path and the looped path differing by an amount that results in a staggered rearrangement of the compressive waves in the paths; a splitter that splits the exhaust flow into the direct path and the looped path; and a merger that merges the exhaust flow from the direct path and the looped path. When the exhaust flow from the direct path and the looped path are merged, at least some noise cancellation occurs. In other embodiments, plural direct paths, looped paths, splitters, and/or mergers can be used in various combinations.

20 Claims, 9 Drawing Sheets

INTERFERENCE-BASED EXHAUST NOISE ATTENUATION

BACKGROUND OF THE INVENTION

1. Field of the Invention

This invention relates to an interference-based exhaust noise attenuation device and method, for example to be used in conjunction with a muffler of an automobile or other vehicle.

2. Description of the Related Art

Exhaust from automobile and other internal combustion engines is extremely noisy unless muffled. This noise is largely a result of compressive waves in the exhaust flow. The conventional arrangement for attenuating the noise is a flow path configuration that includes one or more mufflers, sometimes in combination with resonators.

One problem with conventional mufflers is that they create significant backpressure that can reduce engine efficiency, power output and fuel economy. This reduction can be particularly pronounced during rapid acceleration. Modern engines rely on a certain amount of backpressure from the muffler and are designed accordingly. However, the power and efficiency of an engine are nonetheless compromised at times of greatest demand.

In addition, conventional mufflers and muffler/resonator systems bear the entire burden of attenuating noise produced by an engine. If some other simple device could significantly assist in this process, smaller, simpler, and therefore less expensive mufflers and resonators, if any, could be used.

Compressive waves in exhaust flow can also complicate the design of other exhaust system components that process the flow before the muffler. Examples of such components include but are not limited to pollution control devices and turbines.

SUMMARY OF THE INVENTION

Accordingly, a need exists for a simple device that can significantly reduce the magnitude of compressive waves in exhaust flow from an engine, thereby attenuating the burden on the mufflers, resonators, or other exhaust system components.

One embodiment of the invention is an interference-based exhaust noise attenuation device for exhaust flow from an internal combustion engine that generates compressive waves in the exhaust flow. The device includes a direct path for the exhaust flow and a looped path for the exhaust flow.

Preferably, the volumes of the direct path and the looped path differ by an amount that results in a staggered rearrangement of the compressive waves in the paths. The device also includes a splitter that splits the exhaust flow into the direct path and the looped path, and a merger that merges the exhaust flow from the direct path and the looped path. When the exhaust flow from the direct path and the looped path are merged, at least some noise cancellation occurs due to the staggered rearrangement caused by the differing volumes between the direct path and the looped path.

The foregoing device is simple in construction and should be relatively inexpensive to produce. For some applications, the device might substitute for a muffler or other engine noise suppressing device. However, in a preferred embodiment, the device is placed between an engine and a muffler or other exhaust system component. As a result, a smaller muffler would be needed, and design of other exhaust system components might be simplified.

The device works best with engines that produce evenly spaced pulses in their exhaust output.

The looped path preferably is or includes a portion that is helical in shape. In one embodiment, the looped path is formed from two hollow curved half-tubes that when welded together form a single tube curved into a true helix. In an alternative embodiment, the looped path is not truly helical, but rather is formed from joining two J-bent tubes. This can simplify construction. Other arrangements can be used.

In other embodiments, one or more direct paths, one or more looped paths, one or more splitters, and one or more mergers can be used in various combinations.

Embodiments of the invention also encompass methods implemented by the foregoing devices.

This brief summary has been provided so that the nature of the invention may be understood quickly. A more complete understanding of the invention may be obtained by reference to the following description of the preferred embodiments thereof in connection with the attached drawings.

DESCRIPTION OF THE PREFERRED EMBODIMENT

Figure 1:
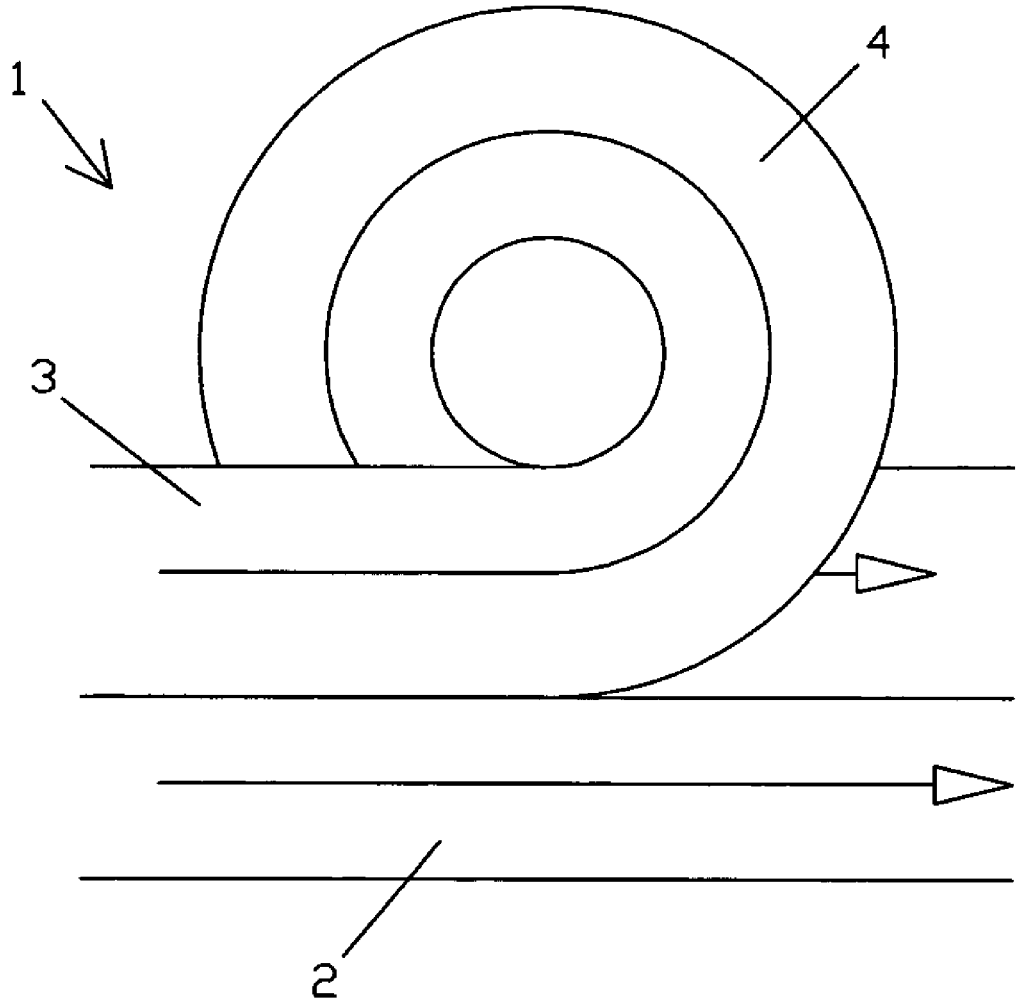
FIGS. 1 and 2 show an embodiment of an interference-based exhaust noise attenuation device.
Figure 2:
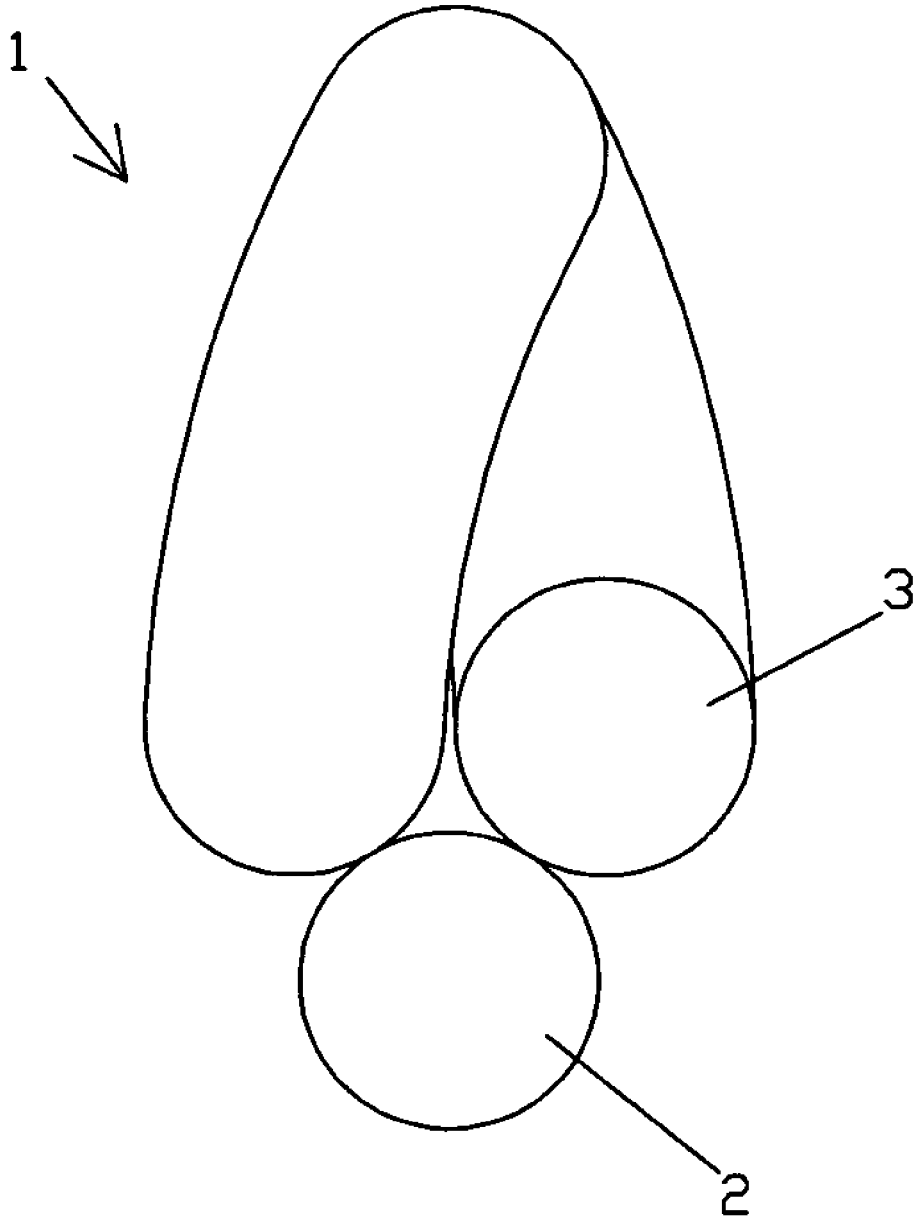

FIGS. 1 and 2 show an embodiment of an interference-based exhaust noise attenuation device.

Briefly, one aspect of the invention is an interference-based exhaust noise attenuation device for exhaust flow from an internal combustion engine that generates compressive waves in the exhaust flow. The device includes a direct path for the exhaust flow and a looped path for the exhaust flow. Volumes of the direct path and the looped path differ by an amount that results in a staggered rearrangement of the compressive waves in the paths. When the exhaust flow from the direct path and the looped path are merged, at least some noise cancellation occurs due to the staggered rearrangement.

In more detail, FIGS. 1 and 2 show device 1 that includes direct path 2 and looped path 3 for exhaust flow from an engine. In FIG. 1, exhaust flow from the engine enters device 1 from the left and exits to the right, preferably on its way to a muffler or other exhaust system component. In FIG. 2, the flow from the engine is into the page. Flow through looped path 3 in FIG. 2 enters on the right, passes/travels through the loop, and exits on the left.

The particular orientations of the figures are merely for ease of description and should not be read to limit the invention in any way. The paths could be on their sides, upside down, or oriented in any other manner. Furthermore, the looped paths could use left-handed or right-handed loops.

In one embodiment, direct path 2 is a straight path, for example formed from a straight duct or tube. In other embodiments, direct path 2 could be or include one or more curved sections of duct or tube.

Looped path 3 can include straight portions leading to and from looped portion 4. In other words, exhaust flow from an engine could be split into the paths before the loop, with the flow for looped path 3 transmitted to the loop through a straight or other shaped joining member. Likewise, flow out of the straight and looped paths could travel some distance before being recombined, again through a straight or other shaped portion. Alternatively, no straight or other shaped portions might be present.

Figure 3:
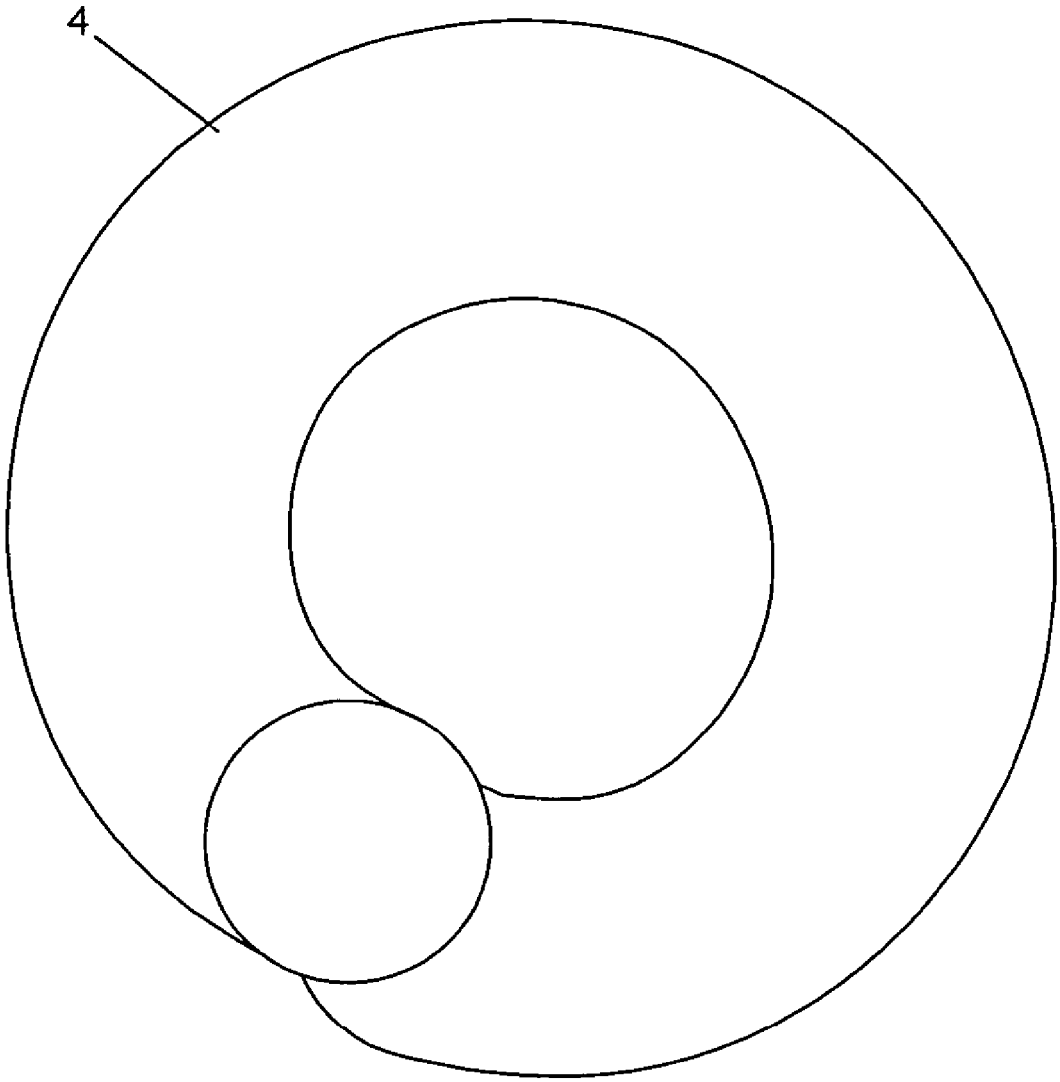
FIG. 3 shows a view of a helical portion of an interference-based exhaust noise attenuation device.

Looped path 3 can take various shapes and can be made in various ways. In a preferred embodiment, looped portion 4 of looped path 3 has a helical shape. This is illustrated in FIG. 3.

A helical shaped looped portion 4 results in a constant acceleration for a compressive wave traveling through the looped portion. Constant acceleration helps to retain the wave's form and therefore facilitates good wave cancellation when the flows from the paths merge.

In one embodiment, looped path 3 is formed from two hollow curved half-tubes (i.e., with semicircular cross-sections) that when welded together form a single tube curved into a true helix.

In another embodiment, looped path 3 is formed by joining two "J-tubes." This approach may not result in a true helix, so some distortion of the compressive wave traveling through the looped path might result. However, acceptable wave cancellation might still occur. Other arrangement can be used.

The paths themselves, as well as all other ducts and tubes used by or with the invention, preferably are cylindrical with a circular cross-sections. Other shapes of ducts and tubes, for example with square, rectangular, elliptical or other shaped cross-sections, can be used. In addition, the cross-sections of the ducts or tubes do not need to be constant throughout the lengths of the ducts or tubes. Thus, the terms "duct" and "tube" both should be read broadly to encompass any duct, tube, passage, path, way, etc. through which a compressive wave can travel.

The ducts or tubes can be formed by casting, extrusion, "hogging out" the ducts or tubes from a solid piece of material, or any other process. In the last example, the tube is a passage through the solid piece of material, akin to how a lava tube is a passage through rock, and the outside of the resulting apparatus might not bear any resemblance to or otherwise reflect the internal ducts or tubes. However, such an apparatus would still be within the scope of the invention as long as the internal ducts or tubes resulted in the appropriate rearrangement of compressive waves, as discussed below.

The exhaust flow from an engine will include standing or traveling compressive waves. This exhaust is split into direct and looped flow paths, resulting in compressive waves in the paths. The volumes of the direct and looped flow paths preferably differ by an amount that results in a staggered rearrangement of the compressive waves in the paths.

While multiple harmonics might be present in exhaust flow from an engine, the flow typically will be characterized by a single dominant compressive wavelength. In one embodiment, the rearrangement is achieved by shifting the compressive waves in the paths relative to each other by one half of this dominant wavelength. Such a shift is symbolically indicated in the figures by different length arrows passing through the paths.

It should be noted that "wavelength shift" refers to only a fractional portion of a total change in wavelength between two paths. Whole-wavelength changes do not have any significant impact and are therefore ignored. For example, if a compressive wave is delayed by a path for 2½ wavelengths, that wave is considered to be shifted by one half of a wavelength relative to an unshifted wave.

For a two path system (i.e., one direct and one looped path), the amount of volume difference between the direct and looped paths that achieves the desired shift preferably is equal to (n+½) times the volume of a compressive wave in the exhaust flow in each path, where n is any integer. In the preferred embodiment, n is zero, resulting in a compact arrangement.

The characteristics of compressive waves in the exhaust flow of a particular engine are typically well known by those working with the design of that engine. If unknown, one skilled in the art of engine design typically would be able to calculate the volume of compressive waves in the exhaust flow from technical data for that engine without undue experimentation or further invention.

For many engines, an estimate of the volume of a compressive wave in the exhaust flow from the engine typically is equal to the volume of an engine cylinder. For a two path system (i.e., one direct and one looped path), half of this volume goes into each path. Thus, an overall equation for the volume difference between direct and looped paths for use in this circumstance is $(n+\frac{1}{2})*Vc/2$, where n is any integer (including zero) and Vc is the displacement of an engine cylinder. In some applications, some correction factor may be necessary depending on the particular design of the engine.

For example, for a 2.0 liter displacement engine with four cylinders, each cylinder has a displacement of 500 ml. Assuming that the compressive waves in the exhaust from the engine have a volume equal to that of a cylinder, compressive waves in each of the paths in a two path embodiment of the invention will have a volume of approximately 250 ml. In that case, the volumes of direct path 2 and looped path 3 preferably should differ by $(n+\frac{1}{2})*250$ ml. Thus, the difference in volumes could be any one of 125 ml, 375 ml, 625 ml, etc.

The invention preferably is used with engines that generate even pulse trains in their exhaust. Such engines include inline four cylinder engines and straight six engines. Applications might also exist for different types of engines, for example Wankel or rotary engines. Different calculations might be used to attain the desired amount of difference in volumes of the paths depending on the engine characteristics, most notably the relationship between cylinder displacement and compressive wavelength. (This relationship varies by engine design; it is a well-known value for any given engine.)

In another situation, exhaust flow from the engine might include plural dominant compressive waves of differing wavelengths. In that case, one of these wavelengths could be selected as the wavelength to be canceled. Alternatively, plural devices such as device 1 could be used, each tuned to one of these wavelengths, or a more complex design using plural direct and/or looped paths could be used.

Figure 4:
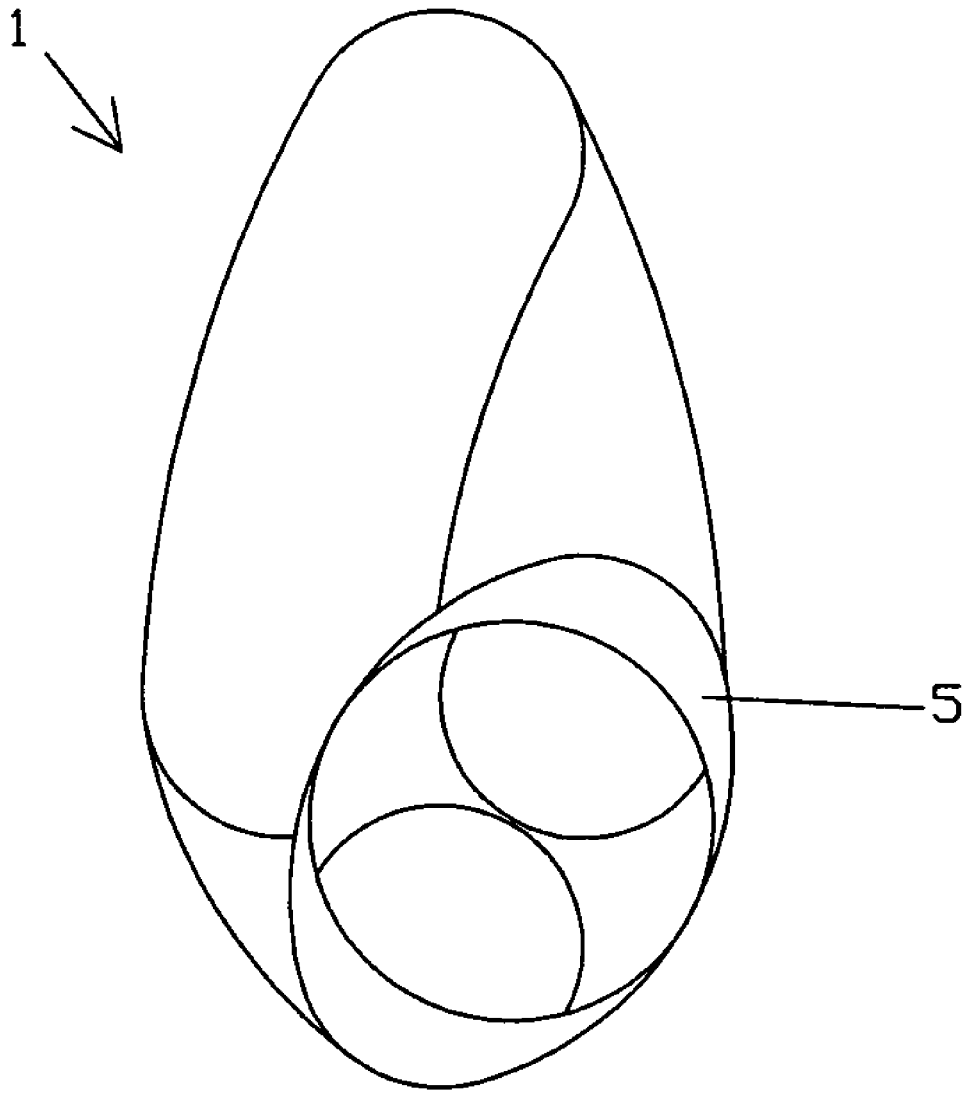
FIG. 4 shows an end-on view of a splitter for an interference-based exhaust noise attenuation device.

FIG. 4 shows an end-on view of a splitter for an interference-based exhaust noise attenuation device. The view in FIG. 4 is identical to the view in FIG. 2, except that splitter 5 has been added. Exhaust flow from typical engines is in or can be directed into a single tube or duct. Splitter 5 splits this flow into the direct path 2 and looped path 3.

Figure 5:
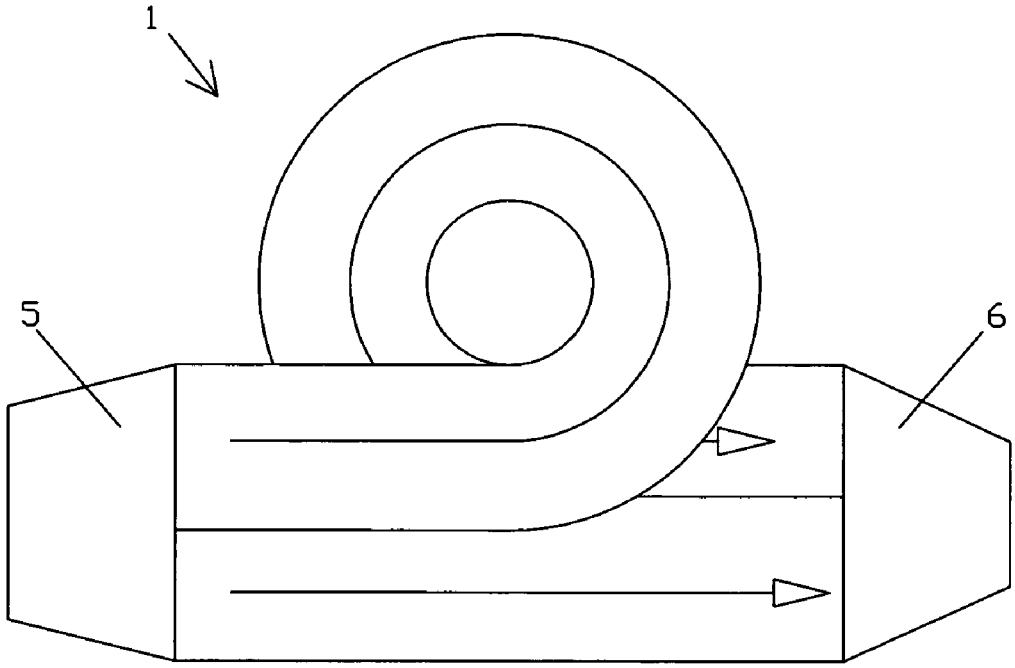
FIG. 5 shows an interference-based exhaust noise attenuation device including both a splitter and a merger.

FIG. 5 shows device 1 with both splitter 5 and merger 6. When the flow exits from device 1, the flows from the direct path and the looped path need to merge so that cancellation can occur. Merger 6 that has a similar structure to splitter 5 can serve to merge the flows.

One possible difference between a splitter and a merger is that the output side of merger 6 preferably is somewhat smaller than the input side of splitter 5 because a smaller path can accommodate the exhaust flow after merging. An analogy is useful for understanding why a smaller path can be used: If the pulses in the exhaust flow are analogized to teeth of a zipper, the exhaust flow from the engine can be viewed as two parts of a zipper with their teeth improperly aligned. Post-merge, the teeth are properly aligned and "zipped" together, resulting in a more compact overall flow. Thus, a smaller path (i.e., duct or tube) can accommodate the merged flow, so the output side of merger 6 can be smaller than the input side of splitter 5. Alternatively, merger 6 can be identical in size and structure to splitter 5, or even possibly larger.

In FIG. 5, direct path 2 is formed from a straight tube connecting the splitter and the merger. In this case, direct path 2 and looped path 3 preferably are parallel at least just after the splitter and also just before the merger. However, this need not be the case.

Figure 6:
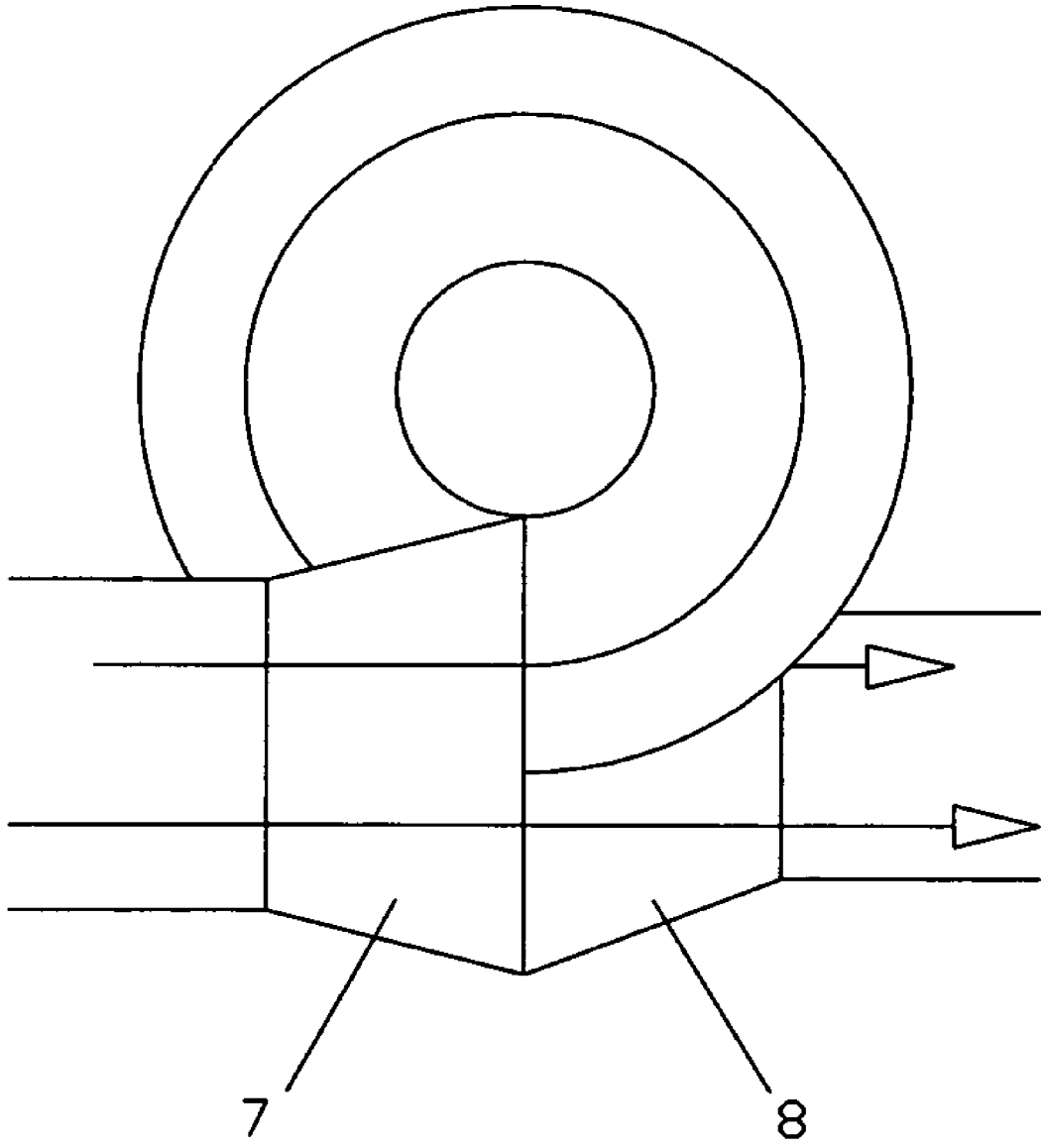
FIGS. 6 and 7 show an interference-based exhaust noise attenuation device including both a splitter and a merger that are joined directly together.
Figure 7:
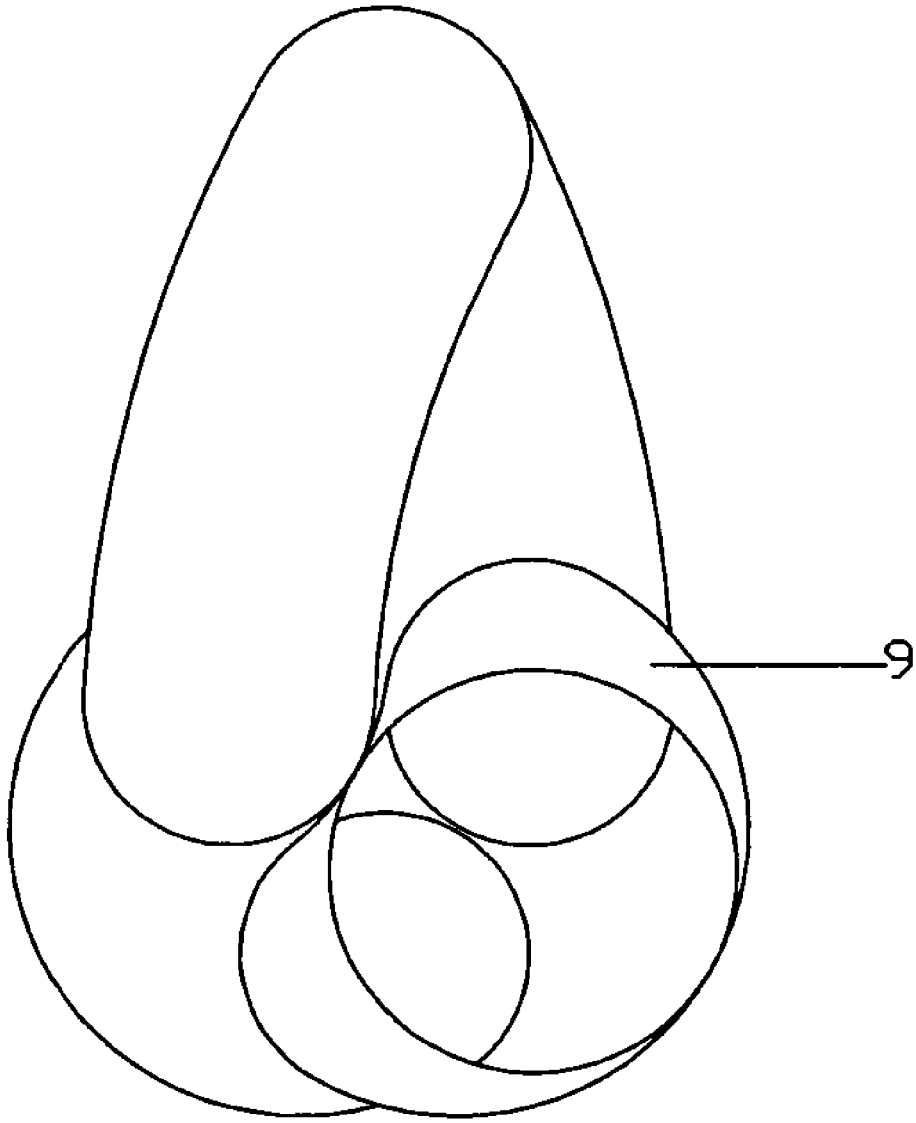

FIGS. 6 and 7 show an interference-based exhaust noise attenuation device in which splitter 7 and merger 8 are joined directly together. This results in a direct path that has a negligible length.

As exhaust flow passes through the device shown in FIGS. 6 and 7, the flow is split by splitter 7 into a direct path and a looped path. The flow that enters the negligible direct path immediately encounters a shifted flow from the looped path, resulting in immediate cancellation of at least some part of the compressive wave in the flow. This arrangement has the advantage of compactness and also of possibly more effective wave cancellation.

In order to accomplish the arrangement shown in FIG. 6, the slitter and merger preferably are shaped around the looped portion of the looped path. One design of splitter 9 that could be used in this arrangement is shown in FIG. 7. The same design could be used for the merger. Other designs are possible.

Preferably, the merged and at least partially wave-cancelled flow from device 1 is passed to a muffler or other exhaust system component for further noise attenuation and processing (e.g., pollution control) or use (e.g., to a turbine for a turbocharger), either directly or through some type of duct.

Figure 8:
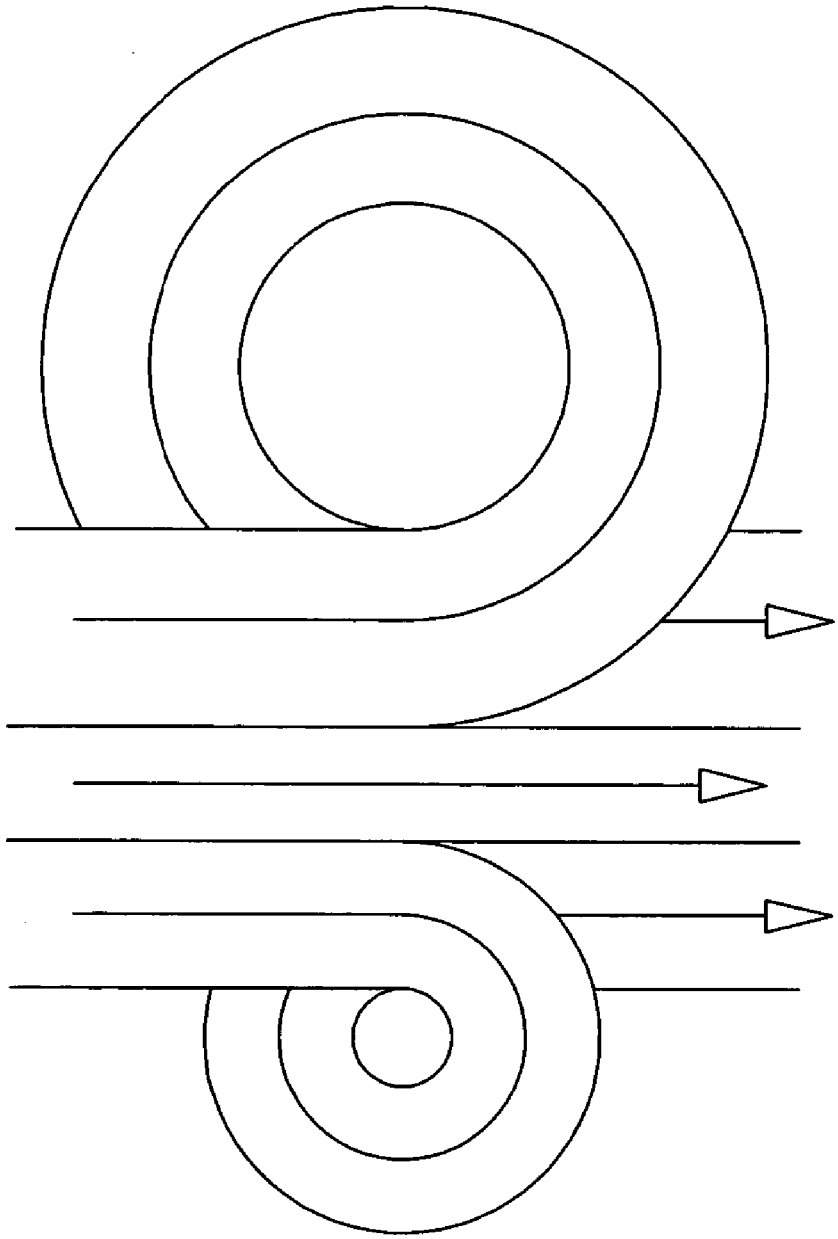
FIG. 8 shows an interference-based exhaust noise attenuation device that uses a direct path and two looped paths.

FIG. 8 shows an interference-based exhaust noise attenuation device that uses a direct path and two looped paths.

Briefly, the invention is not limited to a single direct and/or looped path. This is illustrated in FIG. 8, which shows an embodiment with two looped paths. Embodiments with more paths are possible.

As illustrated in FIG. 8, the plural looped paths do not need to have the same volumes, lengths, or cross-section sizes (or even shapes). This flexibility permits more complex designs, for example to fit available space or to tune the device to cancel portions of multiple wavelengths. Of course, the looped paths can have the same dimensions if so desired.

In one embodiment, the three paths are designed to create three waves that combine to cancel each other out. One arrangement that accomplishes this goal uses paths that result in an unshifted wave (direct path), a ⅓ shifted wave (first looped path), and a ⅔ shifted wave (second looped path).

For an engine with cylinder displacement Vc, this arrangement could include three paths with equal cross-sections: a smaller looped path could have a volume of approximately Vc/9 larger than a direct path, and a larger looped path could have a volume of approximately 2* Vc/9 larger than the direct path. (The volume of the compressive wave going through each path would be Vc/3. The smaller looped path would delay this wave by Vc/9, resulting in a ⅓ wavelength shift. The larger looped path would delay this wave by 2*Vc/9, resulting in a ⅔ wavelength shift.)

Figure 9:
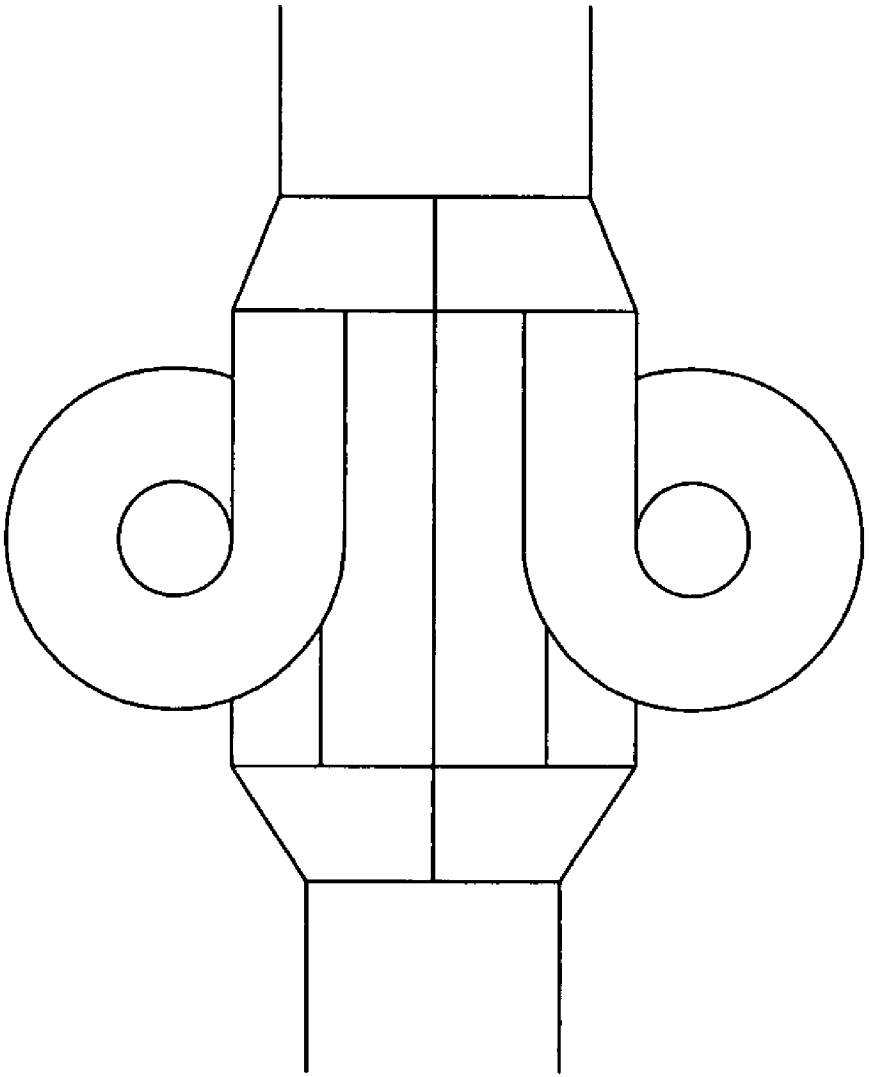
FIG. 9 shows an interference-based exhaust noise attenuation device that uses plural splitters, direct paths, looped paths, and mergers.

Other designs are possible. For example, in other embodiments, one or more splitters, one or more direct paths, one or more looped paths, and/or one or more mergers can be used in various combinations. FIG. 9 shows one arrangement of such an embodiment that includes plural splitters, direct paths, looped paths, and mergers. The invention is not limited to this arrangement.

The differences in volumes between the direct path(s) and the looped path(s) are affected by the different number of paths and the dimensions of those paths. The goal of the volume difference(s) is still the same as with the embodiments discussed above: When the exhaust flow from the direct path(s) and the looped path(s) are merged, at least some noise cancellation should occur due to rearrangements of compressive waves caused by the differing volumes between the direct path(s) and the looped path(s).

The invention can be constructed from any suitably strong, durable, and preferably corrosion-resistant materials. Examples include but are not limited to metals, alloys, and certain synthetic materials.

The invention is in no way limited to the specifics of any particular preferred embodiment disclosed herein. Many variations are possible which remain within the content, scope and spirit of the invention, and these variations would become clear to those skilled in the art after perusal of this application.

What is claimed is:

1. An interference-based exhaust noise attenuation device for exhaust flow from an internal combustion engine that generates compressive waves in the exhaust flow, comprising:

at least three paths including at least a direct path for the exhaust flow and at least two looped paths for the exhaust flow, with volumes of the direct path and the looped paths differing by an amount that results in a staggered rearrangement of the compressive waves in the paths, and with the looped paths looping on opposite sides of the direct path from each other;

a splitter that splits the exhaust flow into at least the three paths; and a merger that merges the exhaust flow from at least the three paths;

wherein when the exhaust flow from the direct path and the looped paths are merged, at least some noise cancellation occurs due to the staggered rearrangement caused by the differing volumes between the direct path and the looped paths.

2. A device as in claim 1, wherein the merger is connected directly or through a duct to a muffler.

3. A device as in claim 1, wherein the amount that the volumes of the direct path and the looped paths differ is equal to the displacement volume of one of the cylinders divided by four.

4. A device as in claim 1, wherein each of the looped paths includes a helical loop.

5. A device as in claim 4, wherein each of the looped paths is formed from two hollow curved half-tubes that when welded together form a single tube curved into the helical loop.

6. A device as in claim 1, wherein each of the looped paths is formed from joining two J-bent tubes.

7. A device as in claim 1, wherein the direct path and the looped paths are parallel at least just after the splitter.

8. A device as in claim 1, wherein the direct path and the looped paths are parallel at least just before the merger.

9. A device as in claim 1, wherein the splitter and the merger are connected by a straight tube to form the direct path.

10. An interference-based exhaust noise attenuation device for exhaust flow from an internal combustion engine that generates compressive waves in the exhaust flow, comprising:

at least three paths including one or more direct paths for the exhaust flow and two or more looped paths for the exhaust flow, with volumes of the direct paths and the looped paths differing by amounts that result in staggered rearrangements of the compressive waves in the paths, and with the looped paths looping on opposite sides of the direct path from each other;

one or more splitters that splits the exhaust flow into at least the three paths; and one or more mergers that merge the exhaust flow from at least the three paths;

wherein when the exhaust flow from the direct paths and the looped paths are merged, at least some noise cancellation occurs due to the staggered rearrangements caused by the differing volumes between the direct paths and the looped paths; and wherein the splitters and the mergers are connected directly together to form the direct paths.

11. A method of interference-based exhaust noise attenuation for exhaust flow from an internal combustion engine that generates compressive waves in the exhaust flow, comprising:

splitting the exhaust flow into at least three paths including at least a direct path and at least two looped paths with a splitter, with volumes of the direct path and the looped paths differing by an amount that results in a staggered rearrangement of the compressive waves in the paths, and with the looped paths looping on opposite sides of the direct path from each other; and merging the exhaust flow from at least the three paths with a merger;

wherein when the exhaust flow from the direct path and the looped paths are merged, at least some noise cancellation occurs due to the staggered rearrangement caused by the differing volumes between the direct path and the looped paths; and wherein the splitter and the merger are connected directly together to form the direct path.

12. A method as in claim 11, wherein the merger is connected directly or through a duct to a muffler.

13. A method as in claim 11, wherein the amount that the volumes of the direct path and the looped paths differ is equal to the displacement volume of one of the cylinders divided by four.

14. A method as in claim 11, wherein each of the looped paths includes a helical loop.

15. A method as in claim 14, wherein each of the looped paths is formed from two hollow curved half-tubes that when welded together form a single tube curved into the helical loop.

16. A method as in claim 11, wherein each of the looped paths is formed from joining two J-bent tubes.

17. A method as in claim 11, wherein the direct path and the looped paths are parallel at least just after the splitter.

18. A method as in claim 11, wherein the direct path and the looped paths are parallel at least just before the merger.

19. A method as in claim 11, wherein the splitter and the merger are connected by a straight tube to form the direct path.

20. A method of interference-based exhaust noise attenuation for exhaust flow from an internal combustion engine that generates compressive waves in the exhaust flow, comprising:

splitting the exhaust flow into at least three paths including one or more direct paths and two or more looped paths with one or more splitters, with volumes of the direct paths and the looped paths differing by amounts that results in staggered rearrangements of the compressive waves in the paths, and with the looped paths looping on opposite sides of the direct path from each other; and merging the exhaust flow from at least the three paths with one or more mergers;

wherein when the exhaust flow from the direct paths and the looped paths are merged, at least some noise cancellation occurs due to the staggered rearrangements caused by the differing volumes between the direct paths and the looped paths; and wherein the splitters and the mergers are connected directly together to form the direct paths.

* * * * *